US006176347B1

(12) United States Patent
Chae et al.

(10) Patent No.: US 6,176,347 B1
(45) Date of Patent: Jan. 23, 2001

(54) SEMI-ACTIVE MUFFLER FOR INTERNAL COMBUSTION ENGINE

(75) Inventors: Song-Soo Chae, Suwon; Seok-Tae Hyun, Kyungki-do, both of (KR)

(73) Assignee: Hyundai Motor Company, Seoul (KR)

( * ) Notice: Under 35 U.S.C. 154(b), the term of this patent shall be extended for 0 days.

(21) Appl. No.: 09/429,846

(22) Filed: Oct. 28, 1999

(30) Foreign Application Priority Data

Feb. 18, 1999 (KR) ..... 99-5340
Jun. 10, 1999 (KR) ..... 99-21493

(51) Int. Cl.[7] ..... F01N 1/00
(52) U.S. Cl. ..... 181/254; 181/265; 181/272
(58) Field of Search ..... 181/237, 254, 181/264, 265, 268, 269, 272, 273, 276, 250

(56) References Cited

U.S. PATENT DOCUMENTS 5,971,098 * 10/1999 Suzuki et al. ..... 181/254
5,984,045 * 11/1999 Maeda et al. ..... 181/254
6,065,564 * 5/2000 Uegane ..... 181/237

FOREIGN PATENT DOCUMENTS 0-195749 7/1997 (JP) .

* cited by examiner

*Primary Examiner*—Khanh Dang
(74) *Attorney, Agent, or Firm*—Christie, Parker & Hale, LLP

(57) ABSTRACT

A semi-active muffler for an internal combustion engine comprising a case defining a closed space with a predetermined capacity, the case being partitioned into first, second, and third chambers, a first bypass pipe for communicating the first chamber with the third chamber, a second bypass pipe for communicating the second chamber with the third chamber, an inlet pipe for introducing exhaust gas into the first and second chambers, an outlet pipe for exhausting the exhaust gas introduced into the third chamber from the first and second chambers respectively through the first and second bypass pipes, a valve for selectively opening a downstream end of the second bypass pipe according to a pressure level within the second chamber, and buffer means for reducing an impact and noise when the valve is opened and closed, wherein the buffer means comprises a gap kept between the valve and the downstream end of the second bypass pipe even when the valve is in a completely closed position.

8 Claims, 7 Drawing Sheets

SEMI-ACTIVE MUFFLER FOR INTERNAL COMBUSTION ENGINE

BACKGROUND OF THE INVENTION (a) Field of the Invention

The present invention relates to a muffler for internal combustion engine and, more particularly, to a semi-active muffler which is able to enhance engine performance by reducing back pressure without increasing exhaust resistance as well as reduce the noise level of the exhaust of the internal combustion engine.

(b) Description of the Related Art

Mufflers are used to reduce the noise level of the exhaust of internal combustion engines. To increase the muffling effect, exhaust resistance of the muffler must be increased. However, high exhaust resistance reduce engine performance since the exhaust resistance causes the generation of back pressure in the exhaust part of the engine. On the other hand, minimizing exhaust resistance to reduce the back pressure decreases the muffling effect of the muffler. To solve this dilemma, mufflers providing both a high muffling effect and low exhaust resistance is developed.

For instance, Japanese publication No. 97-195749 (Jan. 16, 1996) discloses a muffler provided with a valve which can be adjusted according to the pressure of the exhaust gases. The inside of the muffler is partitioned into an upstream chamber and a downstream chamber by a separator, and an valve is provided in the separator. In this muffler, when the revolving speed of the internal combustion engine is low, the pressure in the upstream chamber is smaller than the sum of the forces applied from a coil spring and the pressure in the downstream chamber such that the valve of the separator is closed. In this case, since the exhaust pressure is low, the pressure does not affect engine performance even with the closing of the valve.

On the other hand, when engine RPM increases and the pressure has increased to a predetermined pressure, the valve of the separator is opened so that the exhaust resistance is decreased.

Also, when the engine RPM is changed from high revolving range to low RPM, the valve is closed. To reduce the impact and noise generated when the valve is closed, a buffer material is mounted around a circumferential edge of a valve opening.

However, the buffer material hardens with time, partly as a result of it being exposed to high temperature exhaust gases. Accordingly, the hardened buffer material loses its shock-absorbing ability such that noise of the valve closing is increased.

SUMMARY OF THE INVENTION

The present invention has been made in an effort to solve the above problems of the prior art.

It is an object of the present invention to provide a semi-active muffler which does not use buffer material on a valve and therefore reduces the colliding noise associated with the buffer material, such that a uniform level of noise reduction can be maintained regardless of the lapse of time.

To achieve the above object, the semi-active muffler of the present invention comprises a case defining a closed space with a predetermined capacity, the case being partitioned into first, second, and third chambers; a first bypass pipe for communicating the first chamber with the third chamber; a second bypass pipe for communicating the second chamber with the third chamber; an inlet pipe for introducing exhaust gas into the first and second chambers; an outlet pipe for exhausting the exhaust gas introduced into the third chamber from the first and second chambers respectively through the first and second bypass pipes; a valve for selectively opening a downstream end of the second bypass pipe according to a pressure level within the second chamber; and buffer means for reducing an impact and noise when the valve is opened and closed, wherein the buffer means comprises a gap kept between the valve and the downstream end of the second bypass pipe even when the valve is in a completely closed position.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

A first preferred embodiment of the present invention will now be described in detail with reference to FIGS. 1 to 5.

Figure 1:
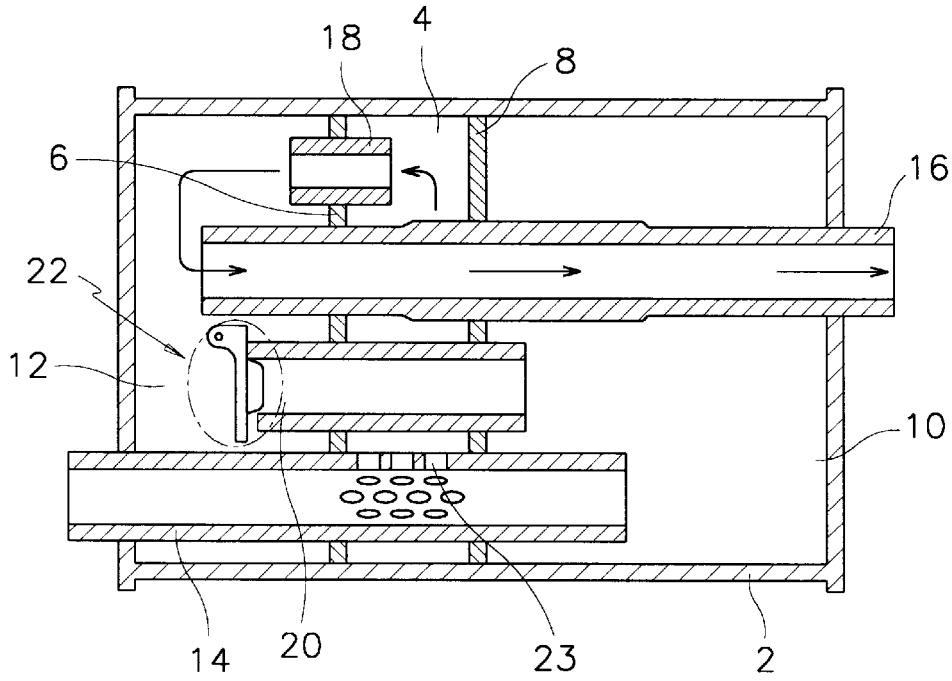
FIG. 1 is a front cross-sectional view of a semi-active muffler according to a first preferred embodiment of the present invention.

Referring first to FIG. 1, the semi-active muffler comprises a case 2 defining a closed space with a predetermined capacity. The case 2 is partitioned by first and second separators 6 and 8 so as to form first, second, and third chambers 4, 10, and 12. The first chamber 4 is positioned between the second and third chambers 10 and 12. The capacities of the first, second, and third chamber 4, 10, and 12 may be varied according to design requirements. In this preferred embodiment of the present invention, the capacities of the chambers 4, 10, and 12 have the following relations: the capacity of the first chamber 4<the capacity of the third chamber 12<the capacity of the second chamber 10. The chambers 4, 10, and 12 communicate with each other through first and second bypass pipes 18 and 20, and an inlet pipe 14 and an outlet pipe 16. The inlet pipe 14 is connected at its upstream end to an exhaust pipe (not shown) and its downstream end is provided in the second chamber 10.

Formed on a central part of the inlet pipe 14, corresponding to the location of the first chamber 4, are a plurality of exhaust holes 23 for distributing the exhaust gas, introduced through the inlet pipe 14 and directed toward the second chamber 10, to the first chamber 4. Also, the outlet pipe 16 communicates with the third chamber 12 at its upstream end and protrudes outside the case 2 at its downstream end such that the exhaust gas led into the second chamber 10 can be discharged outside the muffler. The first bypass pipe 18 communicates the first chamber 4 with the third chamber 12 such that the exhaust gas fed in the first chamber 4 is directed to the third chamber 12. The second bypass pipe 20 communicates the second chamber 10 with the third chamber 12.

With this configuration, the exhaust gas fed to the first chamber 4 through the exhaust holes 23 of the inlet pipe 14 is directed to the third chamber 12 via the first bypass pipe 18, then discharged outside the muffler through the outlet pipe 16. Also the exhaust gas fed to the second chamber 10 through the inlet pipe 14 is directed to the third chamber 12 via the second bypass pipe 20, and then discharged outside the muffler through the outlet pipe 16.

At the downstream end of the second bypass pipe 20, a valve 22 is pivotably mounted. When the pressure of the exhaust gas introduced into the second chamber 10 surpasses to a predetermined level, the valve 22 is opened so that the exhaust gas can be fed into the third chamber 12, and when the pressure is lower than the predetermined level, the valve 22 remains closed such that the exhaust gas is not fed into the third chamber 12.

Figure 2:
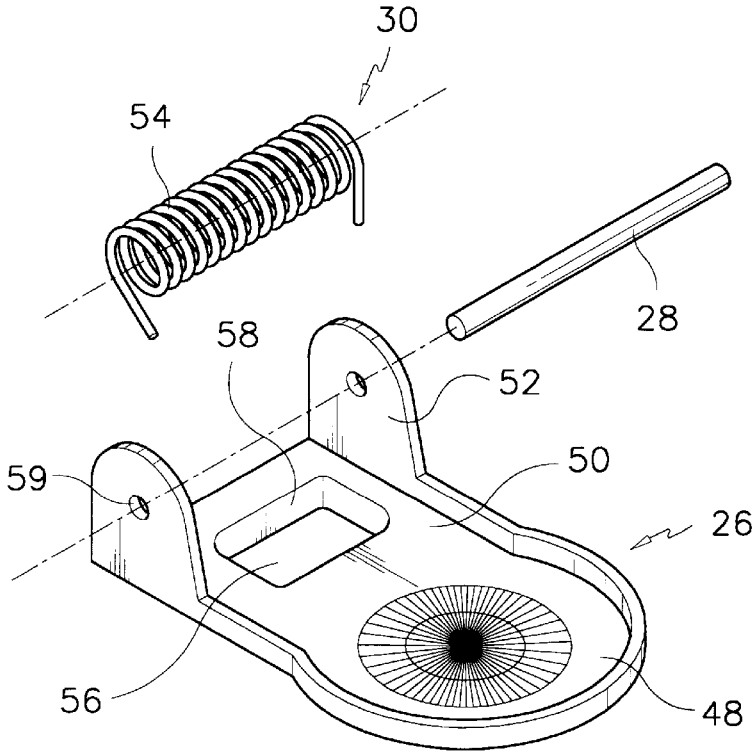
FIG. 2 is a perspective view of a valve, in a disassembled state, of the semi-active muffler shown in FIG. 1.
Figure 2:
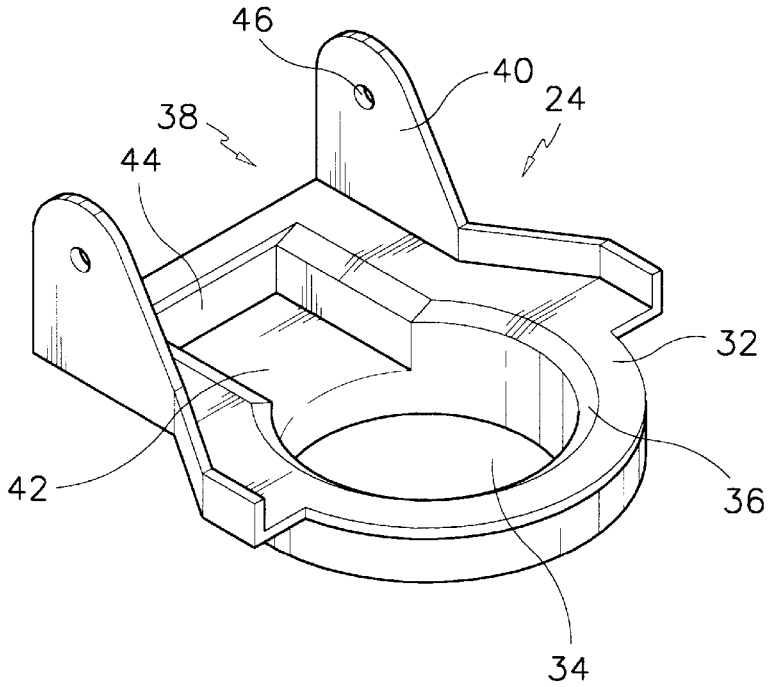
Figure 3:
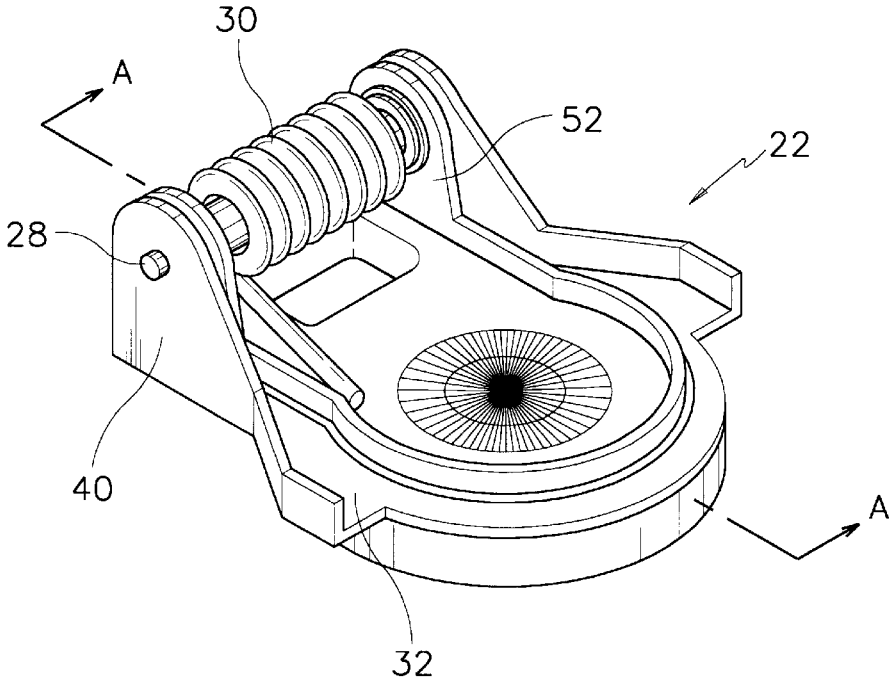
FIG. 3 is a perspective view of the valve of FIG. 2 as assembled.
Figure 4:
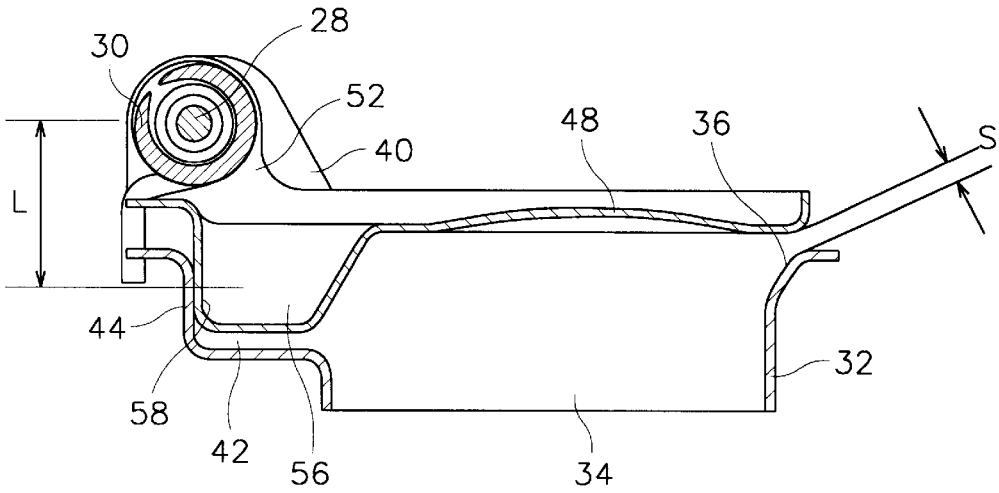
FIG. 4 is a cross-sectional view cut along line A—A of FIG. 3.

FIGS. 2 to 4 show the structure of the valve 22 more in detail.

The valve 22 comprises a valve support member 24, a valve plate 26, a pin 28 for pivotably connecting the valve support member 24 with the valve plate 26, and a coil spring 30 for biasing the valve plate 26 in a valve closing direction.

The valve support member 24 includes a body 32 having a predetermined shape; a central opening 34 formed substantially circular; a cavity 42 defined by walls 44 and formed at a predetermined depth, the cavity 42 opening to the central opening 34; and a pair of first pin supports 40 extending a predetermined distance from the body 32 to define a valve plate mounting bay 38. A first pin hole 46 is provided at distal end portions of each first pin support 40. Further, a tapered part 36 is formed around an upper circumference of the central opening 34 and around an upper circumference of the walls 44.

The valve plate 26 comprises a disk part 48 having a diameter greater than a diameter of the central opening 34 of the valve support member 24, an expansion part 50 extending from one side of the disk part 48, and a pair of second pin supports 52 formed extending from both sides of the expansion part 50, each the second pin support having a second pin hole 59. The second pin supports 52 are positioned inwardly and adjacent to the first pin supports 40 when the expansion part 50 is received in the valve plate mounting bay 38. In the expansion part between the pin supports 52 of the valve plate 26, a stopper 56 is protruded toward the valve support member 24 to be received by the cavity 42 of the valve support member 24.

In a state where the valve plate 26 is disposed on the valve support member 24 as shown in FIG. 3, the pin 28 is inserted through the pin holes 46 and 59 with the coil spring 30 interposed between the second pin supports 52 of the valve plate 26. That is, the pin 28 pass through a longitudinal axis of the coil spring 30.

The coil spring 30 is a torsion coil spring, one end of which contacts the body 32 of the valve support member 24 and the other end of which contacts the body of the expansion part 50 of the valve plate 26, resulting in biasing the valve plate 26 with a predetermined force toward the valve support member 24.

The cavity 42 of the valve support 24 and the stopper 56 of the valve plate 26 is provided to prevent the valve plate 26 from completely closing the opening 34. That is, when the valve plate 26 is in the close position, a wall 58 of the stopper 56 (see FIG. 4) is in contact with the wall 44 of the cavity 42 so as to prevent the valve plate 26 from completely covering the central opening 34. Describing more in detail, since the wall 44 of the cavity 42 of the valve support member 24 is formed so as line up with the pin 28, a distance "L" between the hinge pin 28 and a contact portion of the wall 44 with the wall 58 is minimized. As a result, force of impact and noise caused by collision of the wall 58 of the stopper 56 and the wall 44 of the cavity 42 can is reduced.

Also, the valve is designed to keep a predetermined distance "S" between circumferential edge of the central opening 34 and a circumference of the disk part 48 of the valve plate 26 to reduce the force of impact and noise when the valve is closed. Accordingly, the collision impact and noise can be reduced without use of buffer material, thereby also making the valve highly durable.

The operation of the semi-active muffler according to the first preferred embodiment of the present invention will now be described.

Figure 5:
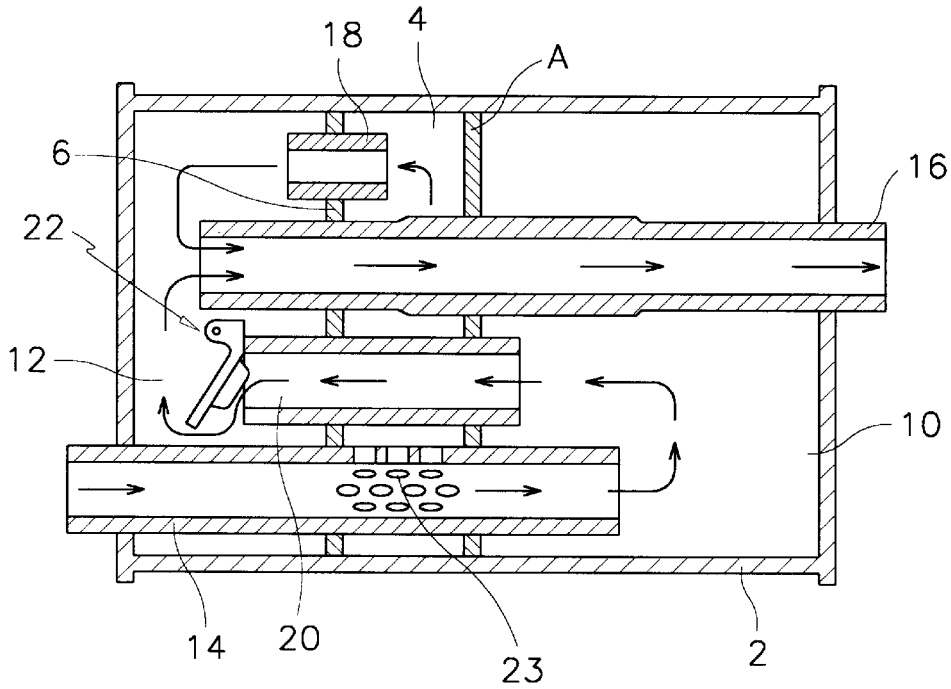
FIG. 5 is a schematic view showing the operation of the semi-active muffler according to the preferred embodiment of the present invention.

As shown in FIG. 5, the exhaust gas from an internal combustion engine is introduced into the first and the second chambers 4 and 10 via the inlet pipe 14. The exhaust gas fed into the first chamber 4 through the exhaust holes 23 of the inlet pipe 14 is directed into the third chamber 12 via the first bypass pipe 18. Meanwhile the exhaust gas led into the second chamber 10 through the inlet pipe 14 is resonated at a predetermined frequency such that the exhaust noise is muffled. The muffled exhaust gas is led into the third chamber 12 via the second bypass pipe 20, then discharged outside the muffler via the outlet pipe 16. Accordingly, the second chamber 10 acts as a resonator to muffle the noise of the exhaust. When the pressure inside the second chamber 10 is reduced due to a slow-down in the RPM of the internal combustion engine, the operative force of the pressure inside the second chamber 10 which passes through the second bypass pipe 20 and acts on the valve plate 26 in a leftward direction (in the drawing) is smaller than the sum of the biasing force applied by the coil spring 30 and the pressure within the third chamber 12 which both act on the valve plate 26 in a rightward direction (in the drawing). Accordingly, the valve 22 remains closed as shown in FIG. 1, and the muffling effect is increased.

When the pressure inside the second chamber 10 is increased due to an increase in RPM of the internal combustion engine, the operative force of the pressure inside the second chamber 10 which passes through the second bypass pipe 20 and acts on the valve plate 26 in a leftward direction in the drawing) overcomes the sum of the biasing force applied by the coil spring 30 and the pressure within the third chamber 12, which both act on the valve plate 26 in a rightward direction (in the drawing) such that the valve 22 is opened. Thus, the exhaust resistance is decreased.

The exhaust gas led into the third chamber 12 from the first and the second chambers 4 and 10 is discharged outside the muffler via the outlet pipe 16.

Figure 6:
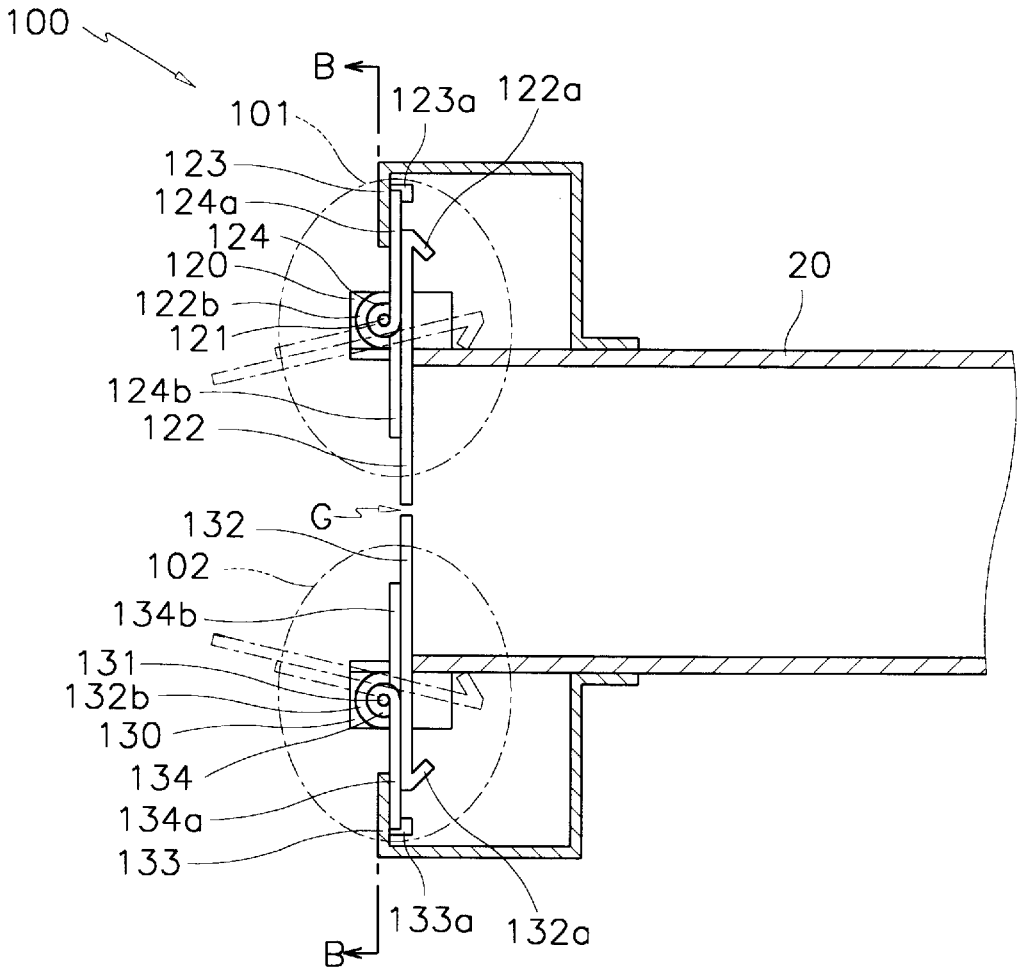
FIG. 6 is a partial sectional view of a muffler according to a second preferred embodiment of the present invention.
Figure 7:
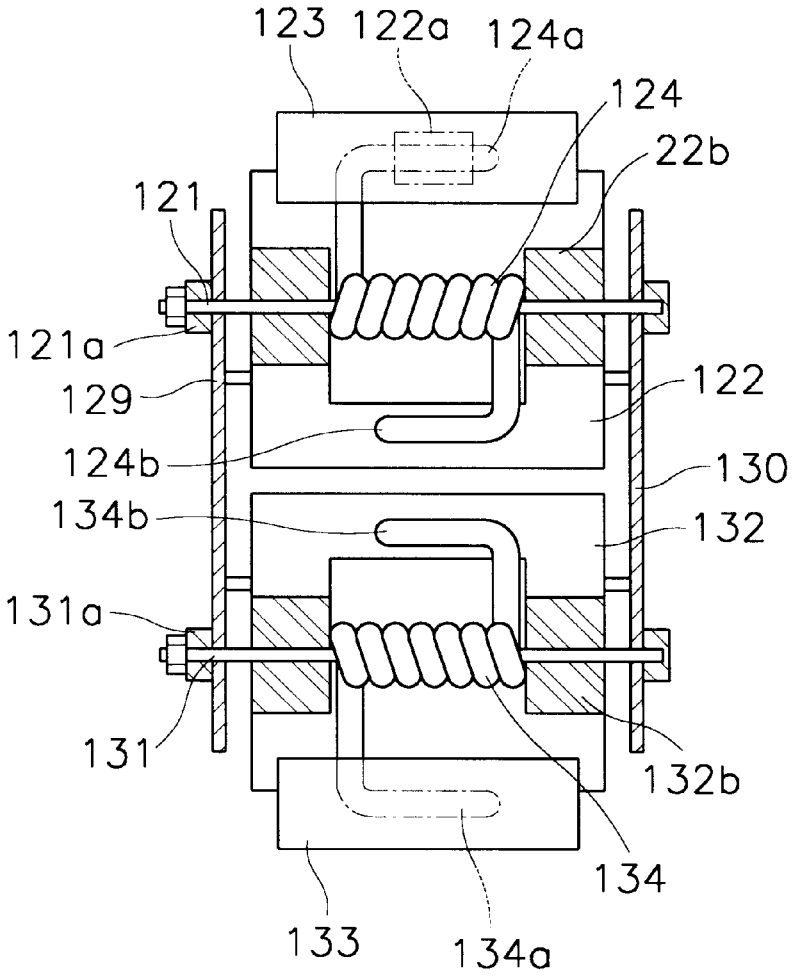
FIG. 7 is a cross-sectional view cut along line B—B of FIG. 6.

FIGS. 6 and 7 respectively show a partial sectional view of a semi-active muffler according to a second preferred embodiment of the present invention and a cross-sectional view taken along line B—B of FIG. 6.

A valve 100 is mounted at the downstream end of the second bypass pipe 20. The valve 100 of this embodiment comprises first and second valve members 101 and 102. The first and the second valve members 101 and 102 are respectively mounted on upper and lower portions (in the drawing) of the downstream end of the second bypass pipe 20.

The first valve member 101 includes a first valve plate 122, a first pin 121, a first coil spring 124, and a first stopper 123. A pair of pin supporting plates 129 and 130 is also formed at the downstream end of the second bypass pipe 20. The first pin 121 is supported by the pin supporting plates 129 and 130 and support projections 121*a* such that the first pin 121 serves as a fulcrum for the valve plate 122. The first coil spring 124 is interposed between the pin supporting plates 129 and 130 and the first pin 121 passes through a longitudinal axis of the first coil spring 124, with its one arm portion 124*a* fixed to a fixing projection 123*a* formed on an inner wall of the first stopper 123 and the other arm portion 124*b* contacting the valve plate 122. The first stopper 123 is formed to limit the amount the first valve member 101 can close by blocking the first valve plate 122, which is rotatably connected to the first pin 121, by penetrating the first pin 121 through holes of protrusion portions 122*b* formed on a back surface of the first valve plate 122.

The second valve member 102 includes a second valve plate 132, a second coil spring 134, a second pin 131, and a second stopper 133. Since the structure of the second valve member 102 is similar to the first valve member 101, a detailed explanation of the second valve member 102 will be omitted.

Although the structures of the first and second valve members 101 and 102 are similar as stated above, elastic forces of the first and the second springs 124 and 134 are different from each other. The elastic force of the first spring 124 is set equal to a predetermined medium-level pressure of the exhaust gas such that the first valve plate 122 is opened when the pressure of the exhaust gas from the internal combustion engine is higher than the predetermined medium-level pressure. On the other hand, the elastic force of the second spring 134 is set less than a predetermined high-level pressure of the exhaust gas such that the second valve plate 132 is opened when the pressure of the exhaust gas from the internal combustion engine is greater than or equal to the predetermined high-level pressure.

The first and the second valve plate 122 and 132 are arranged with a predetermined gap therebetween so that the first and the second valve plates 122 and 132 do not collide.

The operation of the semi-active muffler according to the second embodiment of the present invention will now be described.

As shown in FIG. 5, the exhaust gas from the internal combustion engine is introduced to the first and the second chambers 4 and 10 via the inlet pipe 14. The exhaust gas fed into the first chamber is fed into the third chamber 12 via the first bypass pipe 18. Meanwhile the exhaust gas led into the second chamber 10 is resonated at a predetermined frequency such that the exhaust noise is muffled. The muffled exhaust gas is led into the third chamber 12 via the second bypass pipe 20, then discharged outside the muffler via the outlet pipe 16. The second chamber 10 acts as a resonator to muffle the noise of the exhaust.

When the pressure inside the second chamber 10 is low due to the low RPM of the internal combustion, the operative force of the pressure inside the second chamber 10 which passes through the second bypass pipe 20 and acts on the valve plates 122 and 132 in a leftward direction (in the drawing) is smaller than the sum of the biasing force applied by the coil springs 124 and 134 and the pressure within the third chamber 12 which both act on the valve plates 122 and 132 in a rightward direction in FIG. 1. Accordingly, the valve 100 remains closed, and the muffling effect is increased.

When the pressure inside the second chamber 10 is increased over the predetermined medium level pressure and less than the predetermined high level pressure, due to an increase in the RPM of the internal combustion engine, the operative force of the pressure inside the second chamber 10 which passes through the second bypass pipe 20 and acts on the valve plates 122 and 132 in a leftward direction (in the drawing) overcomes the biasing force applied by the coil spring 124, which both act on the first valve plate 122 in a rightward direction in FIG. 1 such that only the first valve plate 122 on which relatively small elastic force is applied by the first coil spring 124 is opened.

When the pressure inside the second chamber 10 is further increased over the predetermined high level pressure due to an increase in the RPM of the internal combustion engine, the operative force of the pressure inside the second chamber 10, which passes through the second bypass pipe 20 and acts on the valve plates 122 and 132 in a leftward direction (in the drawing), overcomes the urging force applied to the first and second valve plates 122 and 132 by both the coil springs 124 and 134 and the pressure within the third chamber 12, which act on the valve plates 122 and 132 in a rightward direction in FIG. 1, such that the first and the second valve plate 122 and 132 are opened.

Even if the pressure of the exhaust gas increases, the back pressure does not increase abruptly because the pressure of the increased exhaust gas must be such to overcome the elastic forces of the coil springs 124 and 134 to selectively open the valve members 101 and 102, resulting in an enhancement in engine performance.

As described above, in the first preferred embodiment of the present invention specifying the semi-active muffler having a valve which can be closed and opened, when the valve is closed, the predetermined gap is kept between the valve support member and the valve plate such that a reduction in the colliding impact force and noise can be achieved Moreover, by minimizing the distance between the contact portion of the valve support member and the valve plate and the rotational axis of the valve plate such that the durability of the valve is improved as well as the reduction in the colliding impact force and noise.

According to the second embodiment of the present invention, the valve has two valve plates which are selectively opened and closed according to the pressure level of the exhaust such that the back pressure is not abruptly increased, resulting in enhancement of the engine performance.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A semi-active muffler for an internal combustion engine comprising:

a case defining a closed space with a predetermined capacity, the case being partitioned into first, second, and third chambers;

a first bypass pipe for communicating the first chamber with the third chamber; a second bypass pipe for communicating the second chamber with the third chamber;

an inlet pipe for introducing exhaust gas into the first and second chambers;

an outlet pipe for exhausting the exhaust gas introduced into the third chamber from the first and second chambers respectively through the first and second bypass pipes;

a valve for selectively opening a downstream end of the second bypass pipe according to a pressure level within the second chamber; and buffer means for reducing an impact and noise when the valve is opened and closed, wherein the buffer means comprises a gap kept between the valve and the downstream end of the second bypass pipe even when the valve is in a completely closed position.

2. A semi-active muffler of claim 1 wherein the valve comprises: a valve support member including a body, a central opening, a pair of first pin supports defining a valve plate mounting bay, and a cavity formed in the body between the first pin supports, a valve plate including an expansion part having a pair of second pin supports, and a stopper protruded in the opposite direction of the pin supports such that the stopper is able to move in and out the cavity of the valve support member; and an elastic member interposed between the second pin supports by a pin penetrating through a longitudinal axis of the elastic member together with the pin supports.

3. A semi-active muffler in claim 1 wherein the first, second, and third chambers have capacities with the following relation: the capacity of the first chamber<the capacity of third chamber<the capacity of the second chamber.

4. A semi-active muffler in claim 2 wherein a wall of the cavity opposite the central opening and a corresponding wall of the stopper are formed aligned with the longitudinal axis of the pin.

5. A semi-active muffler in claim 2 wherein when the valve is closed, the gap "G" is kept between the valve support and the valve plate around the central opening.

6. A semi-active muffler in claim 1 wherein the valve comprises first and second valve members, each valve member comprising:

a valve plate;

a pin for serving as a fulcrum for the valve plate;

a coil spring for biasing the plate in one direction; and a stopper for limiting an amount the valve member closes, wherein an elastic force of the coil spring for the valve plate of the first valve member is less than elastic force of the coil spring for the valve plate of the second valve member.

7. A semi-active muffler of claim 6 wherein the first and second valve members are selectively opened according to the pressure level of exhaust gas.

8. A semi-active muffler of claim 6 wherein a predetermined gap is formed between the first and second valve plates.

* * * * *